US011484926B2

(12) United States Patent
Große Lordemann et al.

(10) Patent No.: US 11,484,926 B2
(45) Date of Patent: Nov. 1, 2022

(54) COOLING BAR AND COOLING PROCESS WITH VARIABLE COOLING RATE FOR STEEL SHEETS

(71) Applicant: SMS group GmbH, Düsseldorf (DE)

(72) Inventors: Frederik Große Lordemann, Heiligenhaus (DE); Dirk Schmidt, Mettmann (DE); Roman Dehmel, Grevenbroich (DE)

(73) Assignee: SMS group GmbH, Düsseldorf (DE)

( * ) Notice: Subject to any disclaimer, the term of this patent is extended or adjusted under 35 U.S.C. 154(b) by 231 days.

(21) Appl. No.: 16/765,978

(22) PCT Filed: Oct. 31, 2018

(86) PCT No.: PCT/EP2018/079856
§ 371 (c)(1),
(2) Date: May 21, 2020

(87) PCT Pub. No.: WO2019/101486
PCT Pub. Date: May 31, 2019

(65) Prior Publication Data

US 2020/0360976 A1 Nov. 19, 2020

(30) Foreign Application Priority Data

Nov. 21, 2017 (DE) ..... 10 2017 127 470.7

(51) Int. Cl.
*B21B 45/02* (2006.01)
*C21D 1/667* (2006.01)
(Continued)

(52) U.S. Cl.
CPC ..... *B21B 45/0218* (2013.01); *B21B 45/0233* (2013.01); *C21D 1/667* (2013.01);
(Continued)

(58) Field of Classification Search
CPC ..... B21B 37/44; B21B 37/76; B21B 45/0218; B21B 45/0233; B21B 2263/04; B21B 45/02; C21D 1/667; C21D 11/005
See application file for complete search history.

(56) References Cited

U.S. PATENT DOCUMENTS 3,300,198 A * 1/1967 Clumpner ..... C21D 9/573 134/64 R
4,305,765 A * 12/1981 Wilmotte ..... B21B 37/44 148/661

(Continued)

FOREIGN PATENT DOCUMENTS

CN 101247902 A 8/2008
DE 19805377 A1 * 8/1999

(Continued)

OTHER PUBLICATIONS

Office Action dated Jun. 10, 2021 in corresponding Japanese Application No. 2020-526559; 8 pages including English-language translation.

(Continued)

*Primary Examiner* — Edward T Tolan
(74) *Attorney, Agent, or Firm* — Maier & Maier, PLLC

(57) ABSTRACT

A cooling device with variable cooling rate for treating metal materials, in particular for cooling steel sheets in plate mills, hot strip mills or thermal treatment lines, by means of a spray nozzle cooling system. The cooling device consists of at least two cooling bars one of each two cooling bars being situated on the lower side and the other on the upper side transversely to the sheet travel direction of the sheet and centrally between two roller table rollers and includes a spray nozzle cooling system with which a plurality of full jet nozzles and a plurality of full cone nozzles are associated, the full jet nozzles being arranged symmetrically to the full (Continued)

cone nozzles. A method for operating the cooling device according to the disclosure.

14 Claims, 2 Drawing Sheets

(51) Int. Cl.
*C21D 11/00* (2006.01)
*B21B 37/76* (2006.01)

(52) U.S. Cl.
CPC ..... *C21D 11/005* (2013.01); *B21B 37/76* (2013.01); *B21B 2261/21* (2013.01)

(56) References Cited

U.S. PATENT DOCUMENTS

| | | | | |
|---|---|---|---|---|
| 4,723,562 | A * | 2/1988 | Wilmotte | B21B 45/0218 134/122 R |
| 5,186,018 | A * | 2/1993 | van Ditzhuijzen | C21D 1/62 72/201 |
| 7,523,631 | B2 * | 4/2009 | Fujibayashi | B21B 45/0233 72/201 |
| 7,981,358 | B2 * | 7/2011 | Yamamoto | B21B 45/0218 266/130 |
| 8,012,406 | B2 * | 9/2011 | Yamamoto | B21B 45/0233 266/46 |
| 8,440,133 | B2 * | 5/2013 | Eto | B21B 45/0218 266/46 |
| 9,085,810 | B2 * | 7/2015 | Serizawa | C21D 8/0247 |
| 11,230,748 | B2 * | 1/2022 | Code | B05B 1/06 |
| 2011/0162427 | A1 | 7/2011 | Nakata et al. | |
| 2012/0068391 | A1 * | 3/2012 | Eto | B21B 45/0218 266/44 |
| 2012/0318478 | A1 * | 12/2012 | Weinzierl | C21D 1/667 165/104.11 |
| 2015/0224551 | A1 * | 8/2015 | Haraguchi | B05B 1/32 239/128 |
| 2017/0189949 | A1 | 7/2017 | Duhoux et al. | |

FOREIGN PATENT DOCUMENTS

| | | | | |
|---|---|---|---|---|
| DE | 19854675 | A1 * | 6/2000 | B21B 45/02 |
| EP | 0864847 | A2 | 9/1998 | |
| EP | 1764423 | A1 | 3/2007 | |
| EP | 2047921 | A1 | 4/2009 | |
| EP | 2361699 | A1 | 8/2011 | |
| EP | 2415536 | A1 | 2/2012 | |
| JP | S59-47010 | A | 3/1984 | |
| JP | H06-198314 | A | 7/1994 | |
| JP | H11-2511 | A | 1/1999 | |
| JP | 2004-314113 | A | 11/2004 | |
| JP | 2006-035311 | A | 2/2006 | |
| JP | 2008-073695 | A | 4/2008 | |
| JP | 5123737 | B2 | 1/2013 | |
| WO | 01/47648 | A2 | 7/2001 | |
| WO | 2015/113832 | A1 | 8/2015 | |

OTHER PUBLICATIONS

International Search Report with English translation and Written Opinion with Machine translation dated Jan. 23, 2019 in corresponding International Application No. PCT/EP2018/079856; 17 pages.

International Preliminary Report on Patentability dated Oct. 21, 2019 in corresponding International Application No. PCT/EP2018/079856; 27 pages.

* cited by examiner

COOLING BAR AND COOLING PROCESS WITH VARIABLE COOLING RATE FOR STEEL SHEETS

FIELD

The present disclosure relates to a cooling device with variable cooling rate in plate mills, hot strip mills or thermal treatment lines for treating metal materials. The invention further relates to a cooling process with such a cooling device.

BACKGROUND

The final quality of rolled sheets is largely determined by the first forming steps and a corresponding cooling. Errors that have already occurred in the early stages of the production of the sheet can be difficult or impossible to fix in subsequent lines and thus have a serious negative impact on the quality of the final product.

For example, in plate rolling of steel, the temperature forming path which the rolled stock passes through has considerable influence on the mechanical properties of the rolled stock at the end of the rolling process. This means that the mechanical properties of the intermediate rolled product or final product are dependent on the temperatures at which the rolled stock was rolled at the respective roll pass.

In the so-called thermomechanical rolling of rolled stock, the rolling process is conducted such that the rolled stock is rolled only in certain permissible temperature windows. This means that roll passes and targeted cooling phases need to alternate.

The hardening and subsequent tempering of steel components in thermal treatment lines are also common practice. They ensure that a desired combination of strength and toughness of the material can be specifically set. In principle, this technology is also used in the production of higher-strength steel sheets in sheet metal systems, as disclosed in EP 1 764423 A1, for example. Here, after heating the slab and rolling it down to the final thickness on the plate mill stand in several reversing passes, the sheet is cooled at high speed, for example to room temperature, i.e. the hardening process is performed. This is followed by the tempering process, i.e. the reheating of the strip to 600° C., for example, followed by re-cooling. In this way, sheets having different properties can be flexibly produced in small batches.

Furthermore, it is desirable to be able to set high and low cooling rates for the rolled stock in a hot strip mill or in a plate mill. Corresponding cooling devices are known from EP 2 415 536, EP 2 047 921 or JP 5 123 737, for example, in which high cooling rates can be achieved with water jet cooling and low cooling rates with air fan cooling (forced convection).

In conventional nozzle cooling systems, a water jet is directed in the form of a cylinder at the rolled stock to be cooled. In some areas, this type of cooling achieves very good cooling results. However, it has been found that areas directly adjacent to the cooling jet may not be cooled at all or not to a sufficient extent. In general, such a water cooling system works well with a large water flow rate of the cooling nozzles. With comparatively small amounts of water, however, not enough of the nozzles have a sufficient flow-through volume. The cooling of the rolled stock is uneven, inevitably resulting in internal stresses, which consequently lead to unevenness in the material, which in turn has a negative influence on the quality of the final product. Air cooling can only be used for cooling systems with cooling rates of up to approx. 1 K/s with medium material thicknesses. For steel grades susceptible to cracking, cooling rates of 1 to 2 K/s are required.

SUMMARY

Therefore, an object of the present invention is to provide an apparatus for a cooling device with which both the lowest and very high cooling rates are possible and a maximum uniformity of cooling can be produced transversely to the strip travel direction. Another object is to provide a method for operating the apparatus according to the invention.

According to the teaching of the invention, in order to achieve both a low and a very high cooling rate, while observing maximum uniformity of cooling transversely to the sheet travel direction, it is proposed that the cooling device consist of at least two cooling bars, one of each two cooling bars being situated on the lower side and the other on the upper side transversely to the sheet travel direction and centrally between two roller table rollers, and comprising a spray nozzle cooling system with which a plurality of full jet nozzles and a plurality of full cone nozzles are associated, the full jet nozzles being arranged symmetrically with respect to the full cone nozzles.

Thereby, two cooling systems can be advantageously combined to form a structural unit in a cooling bar. In this way, the individual cooling bar can be designed in a very compact and space-saving manner. Retrofitting an already existing rolling mill with sheet metal cooling is readily feasible, since, according to the invention, the cooling system can be installed between two roller tables without necessitating substantial adjustment work on the roller tables. Due to the symmetrical arrangement of the full jet nozzles and the full cone nozzles in the individual cooling bars, feeding the individual spray nozzles with a cooling medium can also take place symmetrically between two roller table rollers.

At this point it should be noted that the type of nozzle is not necessarily limited to full jet or full cone nozzles. Other types of spray nozzles or types of feed, such as hollow cone nozzles, flat jet nozzles, U-tubes, etc., which can also be installed in the cooling bar in combinations, may also be contemplated.

According to an advantageous embodiment of the cooling device according to the invention, the full jet nozzles can be fed with a cooling medium such that the sheet to be rolled can thereby be cooled at a high cooling rate of 5 to 150 K/s, preferably of 50 K/s. Further, it is provided that the full cone nozzles can be fed with a cooling medium such that the sheet to be rolled can thereby be cooled at a low cooling rate of less than 1 K/s to 19 K/s.

Furthermore, within a cooling bar, it is possible to switch between a high cooling rate by means of a full jet nozzle and a low cooling rate by means of a full cone nozzle, as required and continuously, so that a seamless overlap of cooling rates can thereby be set.

This has the advantage that the properties of the sheet to be rolled can also be set very precisely via the cooling system. A switch can be accomplished with very short response times, so that the material properties desired by the customer can be set or preset by means of the controlled cooling system as required as early as during rolling.

To be able to adjust the cooling rate even more precisely and as sensitively as possible, it is provided that both the full cone nozzles and the full jet nozzles within the cooling bar can be fed with the coolant and operated at the same time or at different times and independently of one another.

It is advantageous to control the coolant quantity and the coolant surge pressure for each spray nozzle in the cooling bar individually and online.

To this end, it is provided that the cooling for the sheet to be rolled is carried out by spray cooling with a coolant, the cooling rate and/or the respective required final temperature being controlled based on the liquid quantity and/or the number of the respective full jet nozzles and cone nozzles (spray nozzles) that are switched on.

According to the method, the sheet to be rolled is cooled depending on the desired grade with a cooling rate set correspondingly, by means of a cooling medium which is conducted into two cooling bars, one of each two cooling bars being situated on the lower side and the other on the upper side of the sheet and transversely to the sheet travel direction and centrally between at least two roller table rollers, and the cooling medium is sprayed onto the sheet to be cooled via a plurality of full jet nozzles and full cone nozzles associated with the cooling bars, the full jet nozzles being arranged symmetrically with respect to the full cone nozzles within the cooling bars.

Further, within a cooling bar, it should be possible to switch between a high cooling rate by means of a full jet nozzle and a low cooling rate by means of a full cone nozzle, as required and continuously, so as to set a seamless overlap of cooling rates. To this end, the coolant quantity and the coolant surge pressure for each spray nozzle (full jet nozzle and full cone nozzle) within the cooling bar should also be controlled individually online. To control the cooling rate correspondingly, at least one control parameter is measured, wherein the control parameter may be the final temperature of the rolled sheet.

Process sensors provide information on the sheet temperature and the actual flatness; it is collected in front of and behind the cooling device and the actual values are compared with target values. From this value information, a model computer calculates online the cooling mode required for the cooling, the cooling time and the required coolant quantity depending on the desired material grade of the strip.

The determined control parameter (obtained/determined by the process sensors) can further be combined with information on the dimension and the material grade and/or with the target properties such as hardness and strength of the sheet to be rolled.

BRIEF DESCRIPTION OF THE DRAWINGS

The disclosure will be explained in more detail below by way of an exemplary embodiment with reference to the accompanying drawings. In the figures.

DETAILED DESCRIPTION

Figures 1, 2:
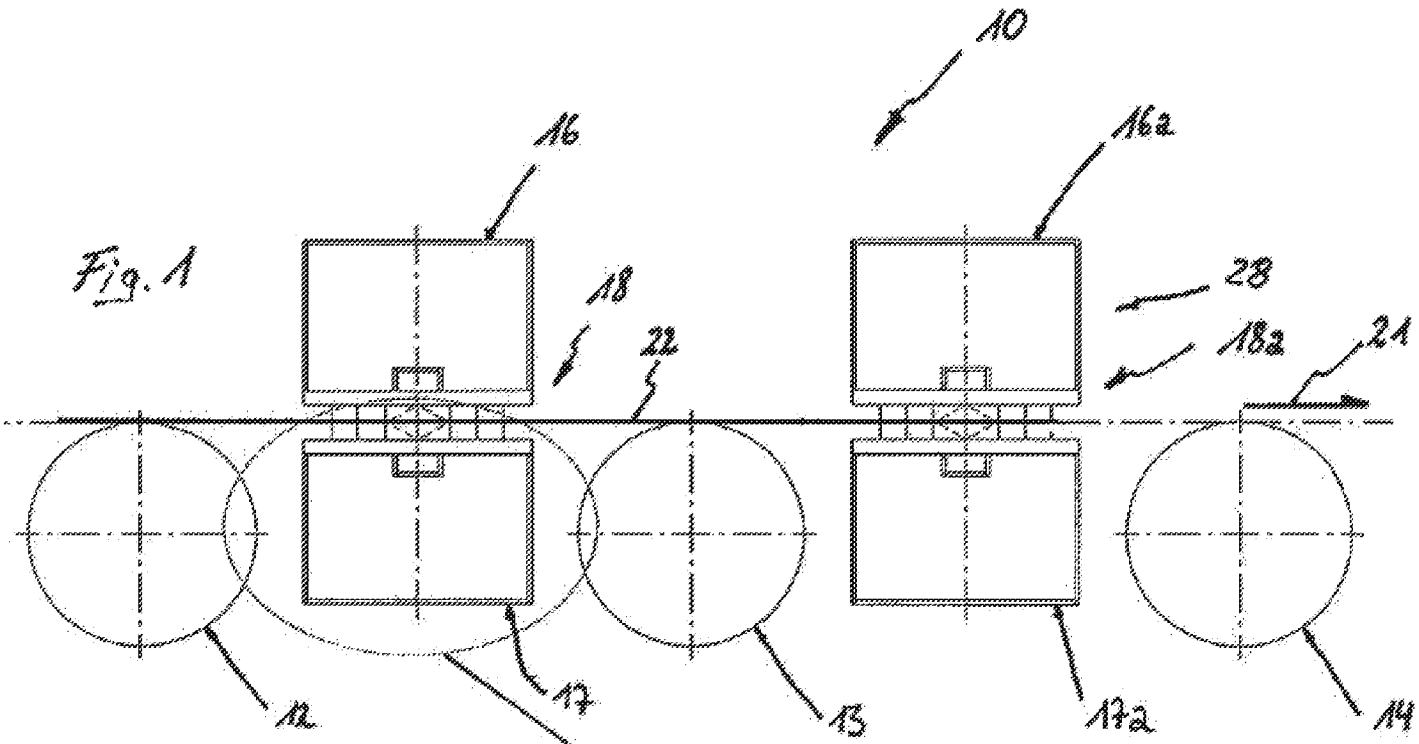
FIG. 1 shows the side view of the cooling device according to the invention in a schematic sectional representation, wherein the cooling device is arranged between two roller tables of a rolling line.
FIG. 2 shows the schematic side view of a cooling bar forming the cooling device in cross-section.

As shown in FIG. 1, apparatus 10 essentially consists of two opposing cooling bars 16, 16*a* and 17, 17*a* arranged between two roller table rollers 12, 13, 14. Cooling bars 16, 16*a* and 17, 17*a* are implemented with a very compact design. To this end, two cooling systems 16 and 17 as well as 16*a* and 17*a* have basically been combined to form a cooling unit 18 and 18*a*.

It is intended for cooling units 18, 18*a* to be operated in an interlinked and synchronized manner. Cooling bars 16, 16*a* are associated with the upper side of the sheet and cooling bars 17, 17*a* with the lower side of the sheet.

FIG. 2 shows an enlarged representation of lower cooling bar 17 of FIG. 1, cooling bars 16, 16*a* and 17*a* being constructed in the same way.

As further shown in FIGS. 1 and 2, the compact design is based on there being at least two types of nozzles, in this case full jet nozzles 19 and full cone nozzles 20, arranged and integrated in cooling bar 16, 16*a* and 17, 17*a* in a special manner. A nozzle cooling system preferably having full jet nozzles 19, 19*a* for a high cooling rate, and a nozzle cooling system preferably having full cone nozzles 20 for low cooling rates (gentle cooling) are installed, by which a cooling medium 29 can be selectively directed at sheet 22.

Full cone nozzles 20 are arranged centrally and full jet nozzles 19, 19*a* are spaced therefrom and arranged in parallel next to full cone nozzles 20 in cooling bar 16, 16*a* and 17, 17*a*. Preferably, the nozzle cooling system is arranged in cooling bar 16, 16*a* and 17, 17*a* transversely to sheet travel direction 20 and over the entire width of a sheet 22 to be rolled.

Figure 3:
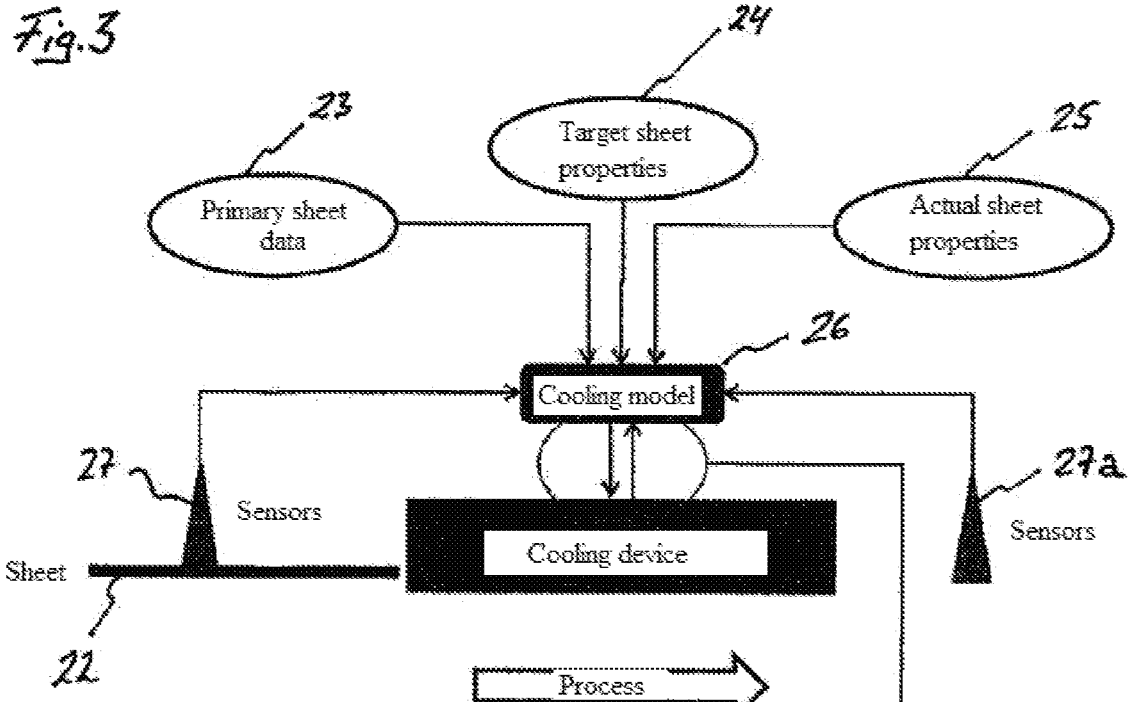
FIG. 3 shows the graphic representation of a cooling device on which the performance of the method according to the invention is to be based.
Figure 4:
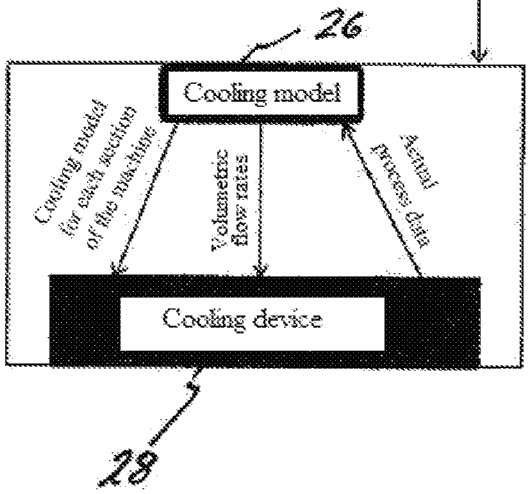
FIG. 4 shows a graphic detail view of the interaction between the computerized cooling model and the cooling device of FIG. 3 according to the invention.

FIG. 3 is a graphic representation showing the control of sheet cooling using cooling system 16, 16*a* and 17, 17*a* of FIG. 2, according to the invention. In principle, preliminary information such as primary sheet data 23, target sheet properties 24 and actual sheet properties 25 can be provided to a cooling model 26 for cooling control. This basic data serves to control cooling device 28. Cooling model 26 is controlled by the values sensed by sensors 27, 27*a*. As such, the actual properties of sheet 22 before cooling can be compared with the target properties after cooling of sheet 22. If the target properties are not reached, this information is transmitted to the cooling model and the cooling device is readjusted accordingly, as shown in FIG. 4.

This ensures a safe and reliable process. The cooling device can be used with maximum flexibility. Manual interventions by operating personnel are minimized by means of automatic control through the model computer.

As such, cooling model 26 interacts perpetually and virtually online with cooling device 28. Thus, a cooling model is possible for each section of the machine. Volumetric flow rates and the actual data are also constantly compared and readjusted if necessary.

This makes it possible to produce maximum uniformity of cooling transversely and longitudinally to the strip travel direction, wherein cooling rates of lowest to very high values can be achieved.

The control concept can be used to operate a plate mill, a hot strip mill or a thermal treatment line, for example, with maximum flexibility. This means that the desired cooling rate can be freely set at any time and over the entire length of the machine. The model computer (not shown) that controls cooling model 26 autonomously decides which cooling application (cooling rate) is necessary and most economical for the material properties to be achieved.

The invention claimed is:

1. A cooling device with variable cooling rate for treating steel materials, comprising:

at least one pair of cooling bars, a first cooling bar of each pair of cooling bars arranged below a sheet to be cooled and a second cooling bar of each pair of cooling bars arranged above the sheet to be cooled, opposite the first cooling bar, wherein each pair of cooling bars is arranged between two roller table rollers, wherein the first and second cooling bars each comprise a spray nozzle cooling system which extends transversely to a travel direction of the sheet to be cooled, wherein the spray nozzle cooling system comprises a row of full cone nozzles extending transversely to the travel direction and a row of full jet nozzles provided on each side of the row of full cone nozzles, and wherein each nozzle of the rows of full cone nozzles and rows of full jet nozzles are individually controllable.

2. The cooling device according to claim 1, wherein a ratio of coolant flow through the rows of full cone nozzles and the rows of full jet nozzles is adjustable to cool the sheet at a rate of 5 to 150 K/s.

3. The cooling device according to claim 1, wherein a ratio of coolant flow through the rows of full cone nozzles and the rows of full jet nozzles is adjustable to cool the sheet at a rate of 1 to 19 K/s.

4. The cooling device according to claim 1, wherein a ratio of coolant flow through the rows of full cone nozzles and the rows of full jet nozzles is adjustable while the cooling device is cooling the sheet.

5. The cooling device according to claim 1, wherein the rows of full jet nozzles are arranged symmetrically about the row of full cone nozzles.

6. The cooling device according to claim 1, wherein flatness sensors and temperature sensors are arranged upstream of the cooling device, and wherein a controller individually controls the nozzles of the rows of full cone nozzles and the rows of full jet nozzles according to a cooling model based on values provided by the flatness sensors and the temperature sensors.

7. The cooling device according to claim 6, wherein a coolant flow rate and a coolant surge pressure are controllable for each nozzle of the rows of full cone nozzles and rows of full jet nozzles.

8. The cooling device according to claim 6, wherein the controller individually controls the nozzles of the rows of full cone nozzles and rows of full jet nozzles to achieve a target hardness of the sheet.

9. A method for operating the cooling device according to claim 1, comprising:

controlling the nozzles according to a cooling model in order to achieve a desired grade in the sheet, and passing the sheet between the at least one pair of cooling bars while flowing a coolant through one or more of the at least one pair of cooling bars to cool the sheet.

10. The method according to claim 9, further comprising:

switching between a high cooling rate and a low cooling rate according to the cooling model, wherein the high cooling rate activates the rows of rows of full jet nozzles and the low cooling rate activates only the rows of full cone nozzles.

11. The method according to claim 10, wherein a coolant quantity and a coolant surge pressure are adjusted for each nozzle of the rows of full cone nozzles and rows of full jet nozzles.

12. The method according to claim 11, wherein at least one control parameter is measured for controlling the cooling rate, and wherein the control parameter is a mechanical property of the sheet comprising at least one of hardness, phase distribution, and grain size.

13. The method according to claim 12, wherein the control parameter is considered with at least one of a dimension, a material grade, and a target property of the sheet.

14. The method according to claim 13, wherein flatness sensors and temperature sensors are arranged both upstream and downstream of the cooling device, and wherein the cooling model compares target output properties with actual output properties of the sheet measured at the sensors arranged downstream of the cooling device, wherein control of the cooling device is adjusted in response to differences between the target output properties and the actual output properties in order to achieve the desired grade.

* * * * *